United States Patent [19]

Kaye

[11] 4,191,219

[45] Mar. 4, 1980

[54] TRIAXIAL FABRIC PATTERN

[75] Inventor: Dianne Kaye, Acton, Mass.

[73] Assignee: Tripoint, Inc., Acton, Mass.

[21] Appl. No.: 888,377

[22] Filed: Mar. 20, 1978

[51] Int. Cl.[2] ..... D03D 13/00

[52] U.S. Cl. ..... 139/383 R; 139/DIG. 1

[58] Field of Search ..... 139/DIG. 1, 383 R, 384

[56] References Cited

U.S. PATENT DOCUMENTS 1,475,250 11/1923 Sundh ..... 139/DIG. 1

FOREIGN PATENT DOCUMENTS 1358056 3/1964 France ..... 139/DIG. 1

14098 of 1892 United Kingdom ..... 139/DIG. 1

*Primary Examiner*—Henry Jaudon

*Attorney, Agent, or Firm*—Milton Oliver

[57] ABSTRACT

In the preferred embodiment, the triaxial fabric is adapted for use as a needlepoint canvas with the yarns forming the fabric being defined in three sets of the yarn courses with the courses within each set being parallel. The courses of each set are angular to the courses of the other two sets, usually at a 60° angle with the courses from all three sets commonly intersecting at a plurality of points in a repetitive pattern over the fabric. Preferably, in one embodiment, one of the sets is at all intersecting points sandwiched between the yarn courses of the other two sets. In an alternate fabric construction the courses of one set are hidden substantially totally by the courses of the other two sets. In this alternate arrangement the other two sets have more courses than the hidden set over a given area.

5 Claims, 3 Drawing Figures

TRIAXIAL FABRIC PATTERN

BACKGROUND OF THE INVENTION

Embroidery and needlepoint fabric has commonly been woven in a simple orthogonal or rectangular pattern. It has been found that such a pattern severely restricts the type of designs that can be made with the rectangular pattern substrate. There are prior art patents that do disclose certain types of triaxial patterns. For example, the Preisig U.S. Pat. No. 264,194 suggests a triangular fringe or border for other fabrics, but does not disclose how its intersections are woven. The Stuart U.S. Pat. No. 1,368,215 discloses a fabric having triangular and trapezoidal pores, but having no three-layer intersections as is important with regard to the present invention. Also, there are a number of triaxial textile and machine patents which have issued to N. F. Doweave, Inc. such as U.S. Pat. No. Re. 28,155; U.S. Pat. Nos. 3,799,209; 3,874,433; 3,965,939; 4,015,637; 4,066,104.

The Dow patents disclose fabrics in which the yarns are interlocked at intersections to prevent slippage and maximize tear resistance. See for example the reissue patent 28,155 in FIG. 1. In that patent no intersection is composed of more than two layers. On the other hand, in accordance with the present invention, the fabric has no such space-consuming interlock arrangement but instead provides the preferred three-layer intersection so as to maximize the porosity of the fabric. This porosity is important from the standpoint of needlepoint work on the fabric especially when using quite fluffy yarns for needlepointing.

SUMMARY OF THE INVENTION

In accordance with the present invention in the preferred form, the fabric has a warp whose threads form the middle layer of each intersection of fabric threads and two wefts, each disposed at an acute angle clockwise or counterclockwise from the warp and which may conveniently be designated as the two o'clock and ten o'clock wefts, respectively. Each weft thread passes alternately over and under the threads running in the other two directions. Thus, if all the threads of one weft pass over one warp thread, they will pass under the adjacent parallel warp threads to the left and right of the first warp thread. If a two o'clock weft thread passes over a particular ten o'clock weft thread, the adjacent parallel two o'clock weft thread passes under the same ten o'clock weft thread, and vice versa.

The fabric may be protected against fraying by folding over at an approximately 60° angle the threads of one weft set at the edge of the fabric to become threads of the other weft set.

The tendency of the threads to slip laterally past one another at the unstabilized intersections of this fabric may be counteracted by starching or glazing the fabric so that each thread remains straight between edges of the fabric. However, for some applications it may be desirable to have this unstabilized intersection as there is then some "give" to the fabric which may be advantageous in some applications depending upon the type of pattern that is being needlepointed.

In another embodiment of the invention which may have other uses, other than as a needlepoint canvas, the warp threads or courses are substantially hidden by two o'clock and ten o'clock wefts thus providing a fabric having a relatively tight knit.

BRIEF DESCRIPTION OF THE DRAWINGS

Numerous other objects and advantages of the present invention will be better understood upon a reading of the following description taken in conjunction with the accompanying drawings, in which.

DETAILED DESCRIPTION OF THE DRAWINGS

Figure 1:
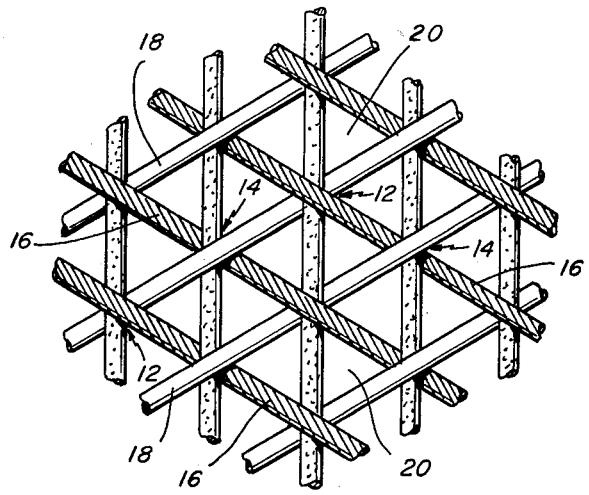
FIG. 1 is a fragmentary enlarged plan view of the preferred embodiment of the fabric of this invention, showing the warp yarn courses running vertically and the two sets of weft yarn courses running crosswise.

In FIG. 1 there is shown a relatively porous embodiment of the fabric of this invention in an enlarged view. The warp comprises a plurality of parallel yarn courses 10 which at intersections 12 and 14 are disposed between the courses 16 and 18 of the 10 o'clock and 2 o'clock wefts, respectively. At intersections 12, the courses of weft 16 are uppermost and the courses of weft 18 are the lowest layer, while at intersections 14, the positions of the wefts are reversed. At both kinds of intersections 12 and 14, the axis of a course 10 intersects the axis of a course 16 and the axis of a course 18. The stacking of courses at intersections, as opposed to the abutting and interlocking of courses featured in prior art triaxial fabrics, allows the creation of large triangular pores 20. When the triaxial fabric is intended as a substrate for embroidery, the embroidering yarns are threaded through the pores 20. The fact that the dimensions of a pore may be made several times that of the bordering yarn courses permits embroidering yarns to fluff out after passing through the pore, facilitating complete coverage of the substrate by the embroidery.

The particular weave arrangement shown in FIG. 1 may be made in a number of different ways. For example, some of the weave machines such as shown in U.S. Pat. No. 4,066,104 may be modified so as to accomplish a weave as taught in accordance with the present invention and shown in FIG. 1. Also, older manual techniques may be employed for providing the weave of FIG. 1 and also the weave of the second embodiment discussed hereinafter.

In FIG. 1 the area of the pores 20 is each triangular-shaped and preferably covers an area comparable to the area of the adjacent yarn courses defining the pore. The pore is also sufficiently sized to receive one or more yarn courses used in needlepointing. The diameter of a yarn courses that passes through the pore is at least on the order of the diameter of one of the courses 10, 16 or 18.

Figure 2:
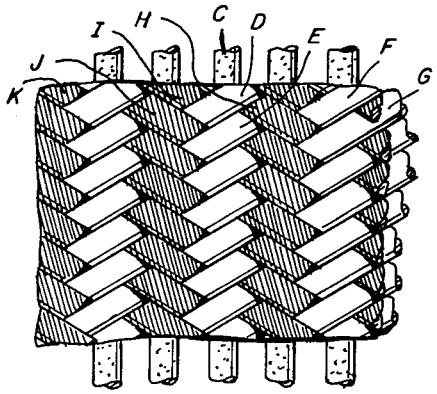
FIG. 2 is a plan view of a second embodiment having more yarn courses in each weft set than in the warp set.
Figure 3:
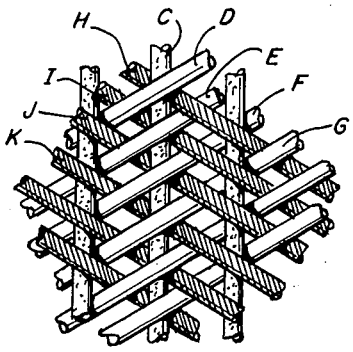
FIG. 3 is a fragmentary view of a section of the fabric of FIG. 2 with the courses slightly exploded for ease in understanding the course arrangements.

FIGS. 2 and 3 show a second embodiment of the invention, wherein the warp courses C are substantially hidden by the alternating weft courses. With regard to the second embodiment the slightly exploded view of FIG. 3 most clearly shows the arrangement of the different yarn courses. In this regard four of the 2 o'clock weft courses are identified as courses D, E, F and G while four of the 10 o'clock weft courses are identified as courses H, I, J and K. The pattern essentially repeats thereafter. In the second embodiment the course D along its length extends over the courses C and H, over the course I, under the course J, and under the course K. The course E extends under the course H, over the courses C and I, over the course J, and under the course K (along with extending under an adjacent C course). Along its length the course F extends under the course H, under the course I, over the courses C and J, and over the course K. Finally, along its length the course G extends over the course H, under the course I (and an adjacent C course), under the course J and over the courses C and K. The other courses H, I, J and K extend as shown in a similar alternating fashion.

Having described a limited number of embodiments, it should now be apparent that these embodiments are exemplary and that the invention covers many variations for producing a variety of different fabric patterns all falling within the spirit and scope of this invention as defined by the appended claims.

What is claimed is:

1. A triaxial fabric comprising a first set of warp yarn courses and second and third sets of weft yarn courses, the yarn courses of each set being woven at an acute angle to and intersecting the yarn courses of each other set, wherein each intersection of a warp yarn course with a weft yarn course includes yarn courses of both said second and said third weft sets, but only alternate intersections along the length of each weft yarn course include a warp yarn course.

2. A triaxial fabric as set forth in claim 1 wherein the angle between the sets of yarn courses is on the order of 60°.

3. A triaxial fabric as set forth in claim 1 wherein the yarn courses of the first set are sandwiched between the yarn courses of second and third sets at all intersecting points along the length of the first set with the second and third sets.

4. A triaxial fabric as set forth in claim 1 wherein adjacent courses of the second set cover one side of one yarn course of the first set while adjacent courses of the third set cover the opposite side of the one yarn course.

5. A triaxial fabric as set forth in claim 1 wherein the yarns of said second and third sets are so tightly woven as to obscure said first set from view.

* * * * *